US011402160B2

(12) United States Patent
Jalbert et al.

(10) Patent No.: US 11,402,160 B2
(45) Date of Patent: Aug. 2, 2022

(54) HEAT TRANSFER FINS

(71) Applicant: Hamilton Sundstrand Corporation, Charlotte, NC (US)

(72) Inventors: Peter L. Jalbert, Granby, CT (US); Leo J. Veilleux, Jr., Wethersfield, CT (US)

(73) Assignee: Hamilton Sundstrand Corporation, Charlotte, NC (US)

( * ) Notice: Subject to any disclaimer, the term of this patent is extended or adjusted under 35 U.S.C. 154(b) by 651 days.

(21) Appl. No.: 14/503,897

(22) Filed: Oct. 1, 2014

(65) Prior Publication Data

US 2016/0097601 A1 Apr. 7, 2016

(51) Int. Cl.
*F28D 15/00* (2006.01)
*F28F 1/12* (2006.01)
*F28D 15/02* (2006.01)

(52) U.S. Cl.
CPC ..... *F28F 1/126* (2013.01); *F28D 15/0275* (2013.01)

(58) Field of Classification Search
CPC ..... F01D 1/00; F04D 5/00; F28D 15/0275; F28D 15/02; F28D 15/0266; F28F 1/126; F28F 2215/06; H01L 23/427; H01L 23/34; H05K 7/20663; H05K 7/20336
USPC ..... 165/104.33
See application file for complete search history.

(56) References Cited

U.S. PATENT DOCUMENTS 5,780,928 A * 7/1998 Rostoker ..... H01L 23/427 257/713
6,062,299 A 5/2000 Choo et al.
7,540,318 B2 * 6/2009 Nitta ..... H01L 23/427 165/104.26
2007/0055325 A1 * 3/2007 Worm ..... A62B 17/005 607/96
2009/0165998 A1 * 7/2009 Xu ..... H01L 23/427 165/80.3
2009/0211277 A1 8/2009 Rummel et al.
2011/0059346 A1 * 3/2011 Jeong ..... H01M 10/6556 429/120
2012/0090816 A1 * 4/2012 Bayazitoglu ..... B23K 26/38 165/72
2012/0111538 A1 * 5/2012 Wang ..... F28D 15/0266 165/104.21

(Continued)

FOREIGN PATENT DOCUMENTS

EP 2543948 A1 1/2013
GB 2166539 A 5/1986
JP S5610694 A 2/1981

OTHER PUBLICATIONS

United Kingdom Search Report and Examination Opinion dated Dec. 18, 2015, issued on corresponding United Kingdom Patent Application No. GB 1517198.6. (7 pages).

*Primary Examiner* — Henry T Crenshaw
*Assistant Examiner* — Kamran Tavakoldavani
(74) *Attorney, Agent, or Firm* — Locke Lord LLP; Daniel J. Fiorello; Gabrielle Gelozin

(57) ABSTRACT

A heat exchanger includes a fin body and a heat pipe having a first portion disposed on or at least partially within the fin body and a second portion extending from the fin body, wherein the heat pipe includes a hollow core filled with a heat pipe working fluid having a liquid phase that is configured to transition to gas and to be returned to the liquid phase at an operational temperature of the heat exchanger.

13 Claims, 3 Drawing Sheets

(56) References Cited

U.S. PATENT DOCUMENTS

2012/0268877 A1* 10/2012 Rice ..... F25B 21/02
361/679.4
2013/0130074 A1* 5/2013 Timmons ..... B60L 3/0046
429/62

* cited by examiner

HEAT TRANSFER FINS

BACKGROUND

1. Field

The present disclosure relates to heat transfer devices, more particularly to heat transfer fins for efficiently transferring heat.

2. Description of Related Art

Certain heat exchangers involve the use of fin type heat transfer devices (fins) for transferring heat to/from a working fluid such as the ambient atmosphere. In some cases, the fins can include hollow channels which allow coolant to flow therein. Air can be passed over the fins to extract heat therefrom or add heat thereto.

Such conventional methods and systems have generally been considered satisfactory for their intended purpose. However, there is always a need in the art for heat exchangers having improved efficiency over the existing devices. The present disclosure provides a solution for this need.

SUMMARY

In at least one aspect of this disclosure, a heat exchanger includes a fin body and a heat pipe having a first portion disposed on or at least partially within the fin body and a second portion extending from the fin body, wherein the heat pipe includes a hollow core filled with a heat pipe working fluid having a liquid phase that is configured to transition to gas and to be returned to the liquid phase at an operational temperature of the heat exchanger.

The fin body can include an elongated shape. The fin body can be rectangular for example. The fin body can define a conduit such that coolant can flow therein.

The heat pipe can extend at least partially into the conduit. The heat pipe can extend normally from a surface of the fin body. The heat pipe can be configured to have a cylindrical pipe shape. It also contemplated that the heat pipe can have a rectangular sheet shape.

The heat exchanger can further comprising a plurality of heat pipes such as those described herein. A mesh structure can be disposed between at least two of the plurality of heat pipes. The plurality of heat pipes can include at least two heat pipes of different size, shape, and/or length. The plurality of heat pipes can include progressively more elongated heat pipes in a direction of flow.

The heat exchanger can further include a second body in thermal communication with the heat pipe at the second portion. The second portion of each heat pipe can be disposed at least partially within the second body.

These and other features of the systems and methods of the subject disclosure will become more readily apparent to those skilled in the art from the following detailed description taken in conjunction with the drawings.

BRIEF DESCRIPTION OF THE DRAWINGS

So that those skilled in the art to which the subject disclosure appertains will readily understand how to make and use the devices and methods of the subject disclosure without undue experimentation, embodiments thereof will be described in detail herein below with reference to certain figures, wherein.

DETAILED DESCRIPTION

Figure 1A:
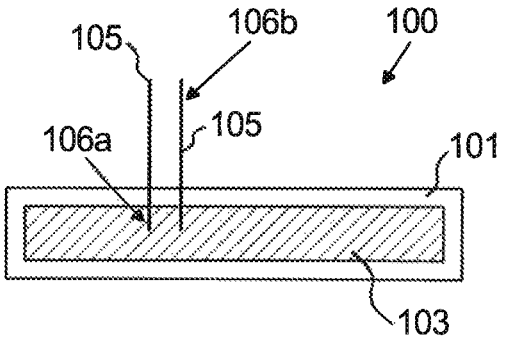
FIG. 1A is a side elevation, cross-sectional schematic view of an embodiment of a heat exchanger in accordance with this disclosure, showing heat pipes disposed on a fin.

Reference will now be made to the drawings wherein like reference numerals identify similar structural features or aspects of the subject disclosure. For purposes of explanation and illustration, and not limitation, an illustrative view of an embodiment of a heat exchanger in accordance with the disclosure is shown in FIG. 1 and is designated generally by reference character 100. Other embodiments and/or aspects thereof are shown in FIGS. 1B-5. The devices, systems, and methods described herein can be used to increase thermal transfer efficiency.

Figure 1B:
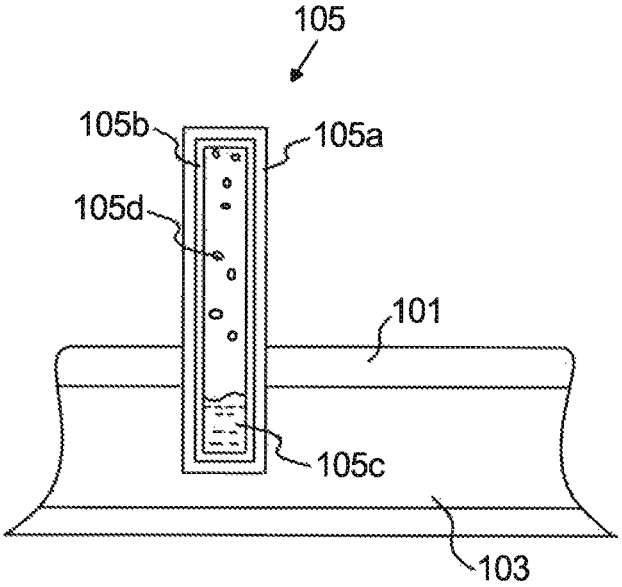
FIG. 1B is a schematic view of a heat pipe in accordance with this disclosure, shown disposed in the fin.

In at least one aspect of this disclosure, referring to FIGS. 1A and 1B, a heat exchanger 100 includes a fin body 101 and a heat pipe 105 having a first portion 106*a* disposed on or at least partially within the fin body 101 and a second portion 106*b* extending from the fin body 101. The fin body 101 can be made of any suitable thermally conductive material (e.g., including a metal). As shown in the embodiment of FIGS. 1A and 1B, the heat pipes 105 are partially inserted into the fin body 101. This can be done in any suitable manner (e.g., drilling suitable holes or mating threads to insert the heat pipes 105 into).

As shown in FIG. 1B, the heat pipe 105 includes a hollow core defined by shell 105*a* and is filled with a heat pipe working fluid having a liquid phase 105*c* that is configured to transition to gas phase 105*d* and to be returned to the liquid phase 105*c* at an operational temperature of the heat exchanger 100. The gas phase 105*d* can be returned to the liquid phase in any suitable manner (e.g., via wicking member 105*b* disposed inside shell 105*a*). The working fluid can be any suitable fluid (e.g., water, alcohol, helium) and can be under any suitable pressure within the shell 105*a*.

Figure 4A:
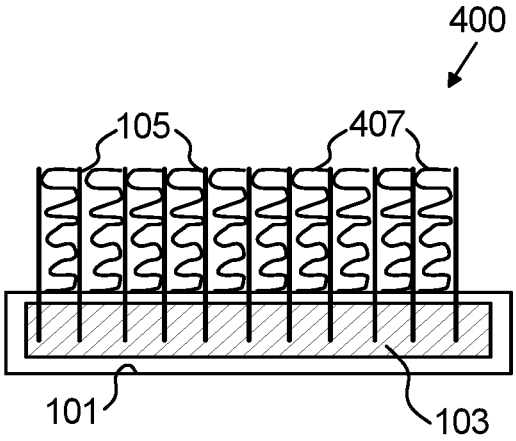
FIG. 4A is a side elevation, cross-sectional schematic view of an embodiment of a heat exchanger in accordance with this disclosure, showing additional mesh structures disposed between each heat pipe.
Figure 4B:
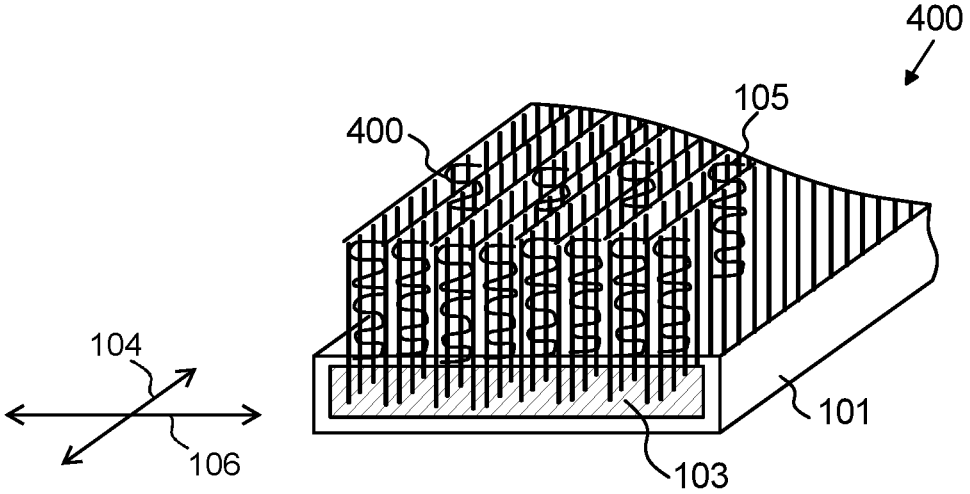
FIG. 4B is a perspective, cross-sectional schematic view of an the heat exchanger of FIG. 4A.

The fin body 101 can define a conduit 103 such that a suitable coolant can flow therethrough (e.g. in a direction 104 as shown in FIG. 4B). The conduit 103 can be of any suitable shape and/or size. The fin body 101 can include an elongated form factor or any other suitable shape. In some embodiments, the fin body 101 is rectangular.

As shown, one or more heat pipes 105 can extend at least partially into the conduit 103. One or more heat pipes 105 can extend normally (i.e., 90 degrees) from a surface of the body 101 or in any other suitable direction/angle from the fin body 101. One or more heat pipes 105 can be configured to have a cylindrical pipe shape or any other suitable shape. For example, in certain embodiments, one or more heat pipes 105 include a rectangular sheet shape.

Figure 2:
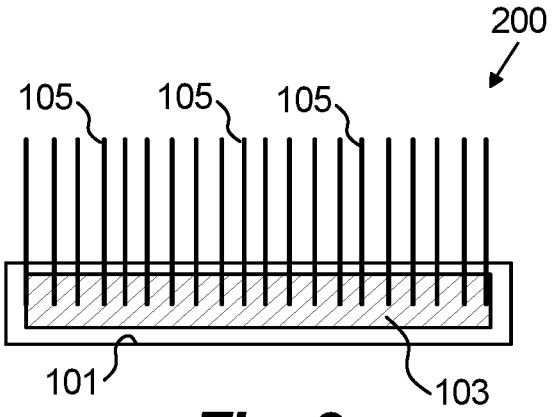
FIG. 2 is a side elevation, cross-sectional schematic view of an embodiment of a heat exchanger in accordance with this disclosure, showing a plurality of heat pipes disposed on a fin.
Figure 3:
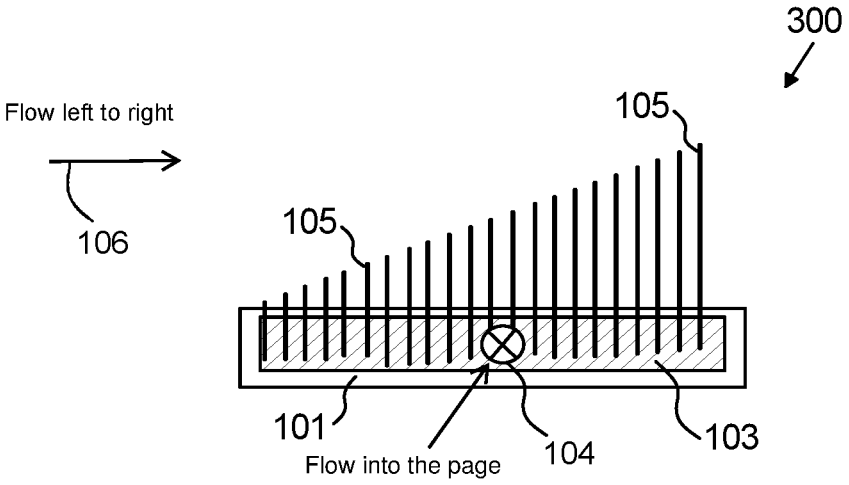
FIG. 3 is a side elevation, cross-sectional schematic view of an embodiment of a heat exchanger in accordance with this disclosure, showing heat pipes of differing sizes disposed on a fin.

Referring to FIG. 2, heat exchanger 200 can include a plurality of heat pipes 105 disposed across the fin body 101 in any suitable manner relative to each other. Referring to FIG. 3, the plurality of heat pipes 105 of heat exchanger 300 can include at least two heat pipes 105 of different size, shape, and/or length. For example, as shown, the plurality of heat pipes 105 can include progressively more elongated heat pipes 105 in a direction of flow. This can account for flow spill-off when heat exchanger 300 is being used as a surface type heat transfer device. Any other suitable arrangement is contemplated herein.

Referring to FIGS. 4A and 4B, a mesh structure 407 (e.g., corrugated sheet metal or other suitable material) can be disposed between at least two of the plurality of heat pipes 105 to increase thermal conduction therebetween and/or to the atmosphere/other working fluid. The mesh structure 407 can be of any suitable shape, size, or length to allow flow to pass therethrough between the heat pipes 105 (e.g. in a direction 106 as shown in FIG. 4*b*).

Figure 5:
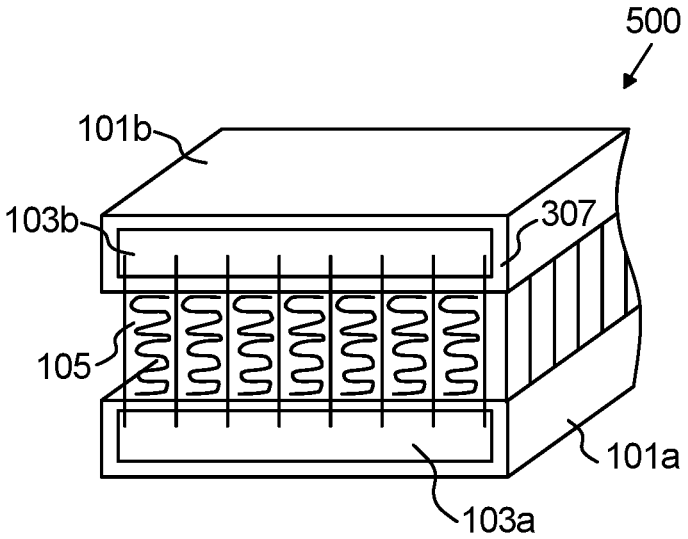
FIG. 5 is a perspective, cross-sectional schematic view of an embodiment of a heat exchanger in accordance with this disclosure, showing a compact fin design having two fins connected together by heat pipes.

Referring to FIG. 5, a heat exchanger 500 can include a first fin body 101*a* and a second fin body 101*b* in thermal communication with one or more of the heat pipes 105. The second fin body 101*b* can be in thermal communication, e.g., in contact for thermal conduction, with the second portion 106*a* of one or more of the heat pipes 105 (e.g., the portion extending away from the first fin body 101*a*). As shown, the first fin body 101*a* can include a conduit 103*a* as described above.

In certain embodiments, the second fin body 101*b* can also include a conduit 103*b* like conduit 103 described above. As shown, the second portion 106*b* of the heat pipes 105 can be disposed at least partially within the second fin body 101*b* in any suitable manner. Additional fin bodies and heat pipes 105 are contemplated herein and can be thermally connected to the first fin body 101*a* and/or second fin body 101*b* in any suitable manner.

The devices, methods, and systems of the present disclosure, as described above and shown in the drawings, provide for heat transfer devices with superior properties including improved thermal transfer efficiency. While the apparatus and methods of the subject disclosure have been shown and described with reference to embodiments, those skilled in the art will readily appreciate that changes and/or modifications may be made thereto without departing from the spirit and scope of the subject disclosure.

What is claimed is:

1. A heat exchanger, comprising:

a fin body, wherein the fin body defines a conduit such that a coolant can flow therethrough; and a heat pipe having a first portion disposed at least partially within the conduit defined by the fin body and a second portion extending from the fin body, wherein the heat pipe includes a hollow core filled with a heat pipe working fluid having a liquid phase in the first portion of the heat pipe that is configured to transition to gas and to be returned to the liquid phase at an operational temperature of the heat exchanger, wherein the heat pipe is fluidly isolated from the conduit defined by the fin body, wherein the heat pipe is a plurality of heat pipes, wherein flow of a working fluid flows between the heat pipes perpendicular to the flow of the coolant through the conduit.

2. The heat exchanger of claim 1, wherein the fin body includes an elongated shape.

3. The heat exchanger of claim 2, wherein the fin body is rectangular.

4. The heat exchanger of claim 1, wherein the heat pipe extends at least partially into the conduit.

5. The heat exchanger of claim 1, wherein the heat pipes extend normally from a surface of the fin body.

6. The heat exchanger of claim 1, wherein a mesh structure is disposed between at least two of the plurality of heat pipes.

7. The heat exchanger of claim 1, wherein the plurality of heat pipes include at least two heat pipes of different size, shape, and/or length.

8. The heat exchanger of claim 7, wherein the plurality of heat pipes include progressively more elongated heat pipes in a direction of flow between the plurality of heat pipes.

9. The heat exchanger of claim 1, further including a second body in thermal communication with the heat pipe at the second portion.

10. The heat exchanger of claim 9, wherein the second portion is disposed at least partially within the second body.

11. The heat exchanger of claim 1, wherein the heat pipe is configured to have a cylindrical pipe shape.

12. The heat exchanger of claim 1, wherein the heat pipe includes a rectangular sheet shape.

13. A heat exchanger, comprising:

a fin body, wherein the fin body defines a conduit such that coolant can flow therethrough; and a heat pipe having a first portion disposed at least partially within the conduit defined by the fin body and a second portion extending from the fin body, wherein the heat pipe includes a hollow core filled with a heat pipe working fluid having a liquid phase in the first portion of the heat pipe that is configured to transition to gas and to be returned to the liquid phase at an operational temperature of the heat exchanger, wherein the heat pipe is fluidly isolated from the conduit defined by the fin body, wherein the heat pipe is a plurality of heat pipes, wherein the plurality of heat pipes include at least two heat pipes of different size, shape, and/or length, wherein the plurality of heat pipes include progressively more elongated heat pipes in a direction of flow between the plurality of heat pipes, wherein the flow through the heat pipes is perpendicular to the flow of coolant through the conduit.

* * * * *